United States Patent [19]

McKinley et al.

[11] 4,268,037

[45] May 19, 1981

[54] TRAINING DEVICE FOR DEVELOPING ROPING SKILLS

[76] Inventors: Victor W. McKinley; Fred D. McKinley, both of R.R. 1, Box 850A, Willcox, Ariz. 85643

[21] Appl. No.: 41,005

[22] Filed: May 21, 1979

[51] Int. Cl.[3] ..... A63B 69/00

[52] U.S. Cl. ..... 273/359; 36/136; 46/1 G; 273/DIG. 18; 434/247

[58] Field of Search ..... 273/359, DIG. 18; 272/1 D; 46/1 G; D21/74, 75; 36/1, 136; 35/29 R; 119/29

[56] References Cited

U.S. PATENT DOCUMENTS

| | | | |
|---|---|---|---|
| D. 171,087 | 12/1953 | Feldman | D21/75 |
| 2,598,218 | 5/1952 | Brumby | 36/136 X |
| 2,644,248 | 7/1953 | Seligman | 272/70.1 UX |
| 3,628,794 | 12/1971 | Conture | 273/DIG. 18 |

*Primary Examiner*—Anton O. Oechsle

*Attorney, Agent, or Firm*—Cahill, Sutton & Thomas

[57] ABSTRACT

A training device mountable upon one's foot develops hand and eye coordination useful in the roping of steers. The device is in the form of a simulated steer head having laterally extending horns which serve as a target for a rope loop thrown by the person upon whose foot the device is mounted.

6 Claims, 4 Drawing Figures

TRAINING DEVICE FOR DEVELOPING ROPING SKILLS

The present invention relates to training devices and, more particularly, to devices for developing skills in roping moving steers.

A large segment of the population, particularly in the West and Southwest, earns a livelihood by raising cattle. In pursuit of this livelihood, the cattlemen must learn to rope calves and steers from horseback. Usually, the basic skills are learned as a child long before the child has sufficient strength or stamina to perform useful work.

The romance and historical significance of cattle and ranching has given rise to the development of rodeos as a form of entertainment and as a medium in which ranch hands can pit their skills against one another. Most rodeos also have special events for different age groups of youngsters. Not only are these events entertaining but they encourage early development of skills which will be mandatory when the youngsters become big enough to work as ranch hands. To develop skills in roping, one must first of all learn how to throw a lariat so as to maintain the loop therein and then learn how to aim and place the loop on target.

U.S. Pat. Des. No. 234,354 illustrates a saw horse-like device having a simulated steer head attached thereto to serve as a target for roping practice. A device of this type will provide a satisfactory but stationary target and affords little practice in roping a calf or a steer which may be turning or twisting its head at the moment at which the loop catches it. To provide practice in roping a moving target, various steer-like moveable targets have been developed. In U.S. Pat. No. 3,711,098, a training apparatus is described which includes a simulated steer mounted upon a pair of runners, which steer is drawn by a retracting cord toward a stationary unit. U.S. Pat. No. 3,776,553 shows and describes a simulated steer which is attached to a guide arm pivoting about a fixed point. Both of these moveable targets are relatively complex and therefore expensive. Moreover, the degree of versatility of movement is limited as the head of the simulated steer is stationary with respect to the body of the steer.

The prior art is replete with various toys incorporating simulated horse/cattle heads, as shown in the following U.S. Pat. Nos. 728,864, 2,526,786, 2,888,263, 2,644,248, and U.S. Des. Pat. Nos. 171,087 and 174,772.

It is therefore a primary object of the present invention to provide a training device for developing hand and eye coordination useful in the roping of steers.

Another purpose of the present invention is to provide a simulated steer's head which is moveable fore and aft and sideways by the user during the act of roping.

Yet another object of the present invention is to provide a simulated steer's head mountable upon a user's foot for practicing roping techniques.

Still another object of the present invention is to provide a training device for practicing roping which device is useable indoors or outdoors.

A further object of the present invention is to provide a training device for youngsters to aid them in learning and practicing roping techniques with a small rope.

A yet further object of the present invention is to provide a lightweight simulated steer's head/roping target which is readily moveable about all three axis to simulate the actual movement of a steer's head when the steer is running.

A still further object of the present invention is to provide an inexpensive training device for learning and practicing steer roping techniques.

These and other objects of the present invention will become apparent to those skilled in the art as the description thereof proceeds.

The present invention may be described with greater specificity and clarity with reference to the following drawings, in which.

Figure 1:
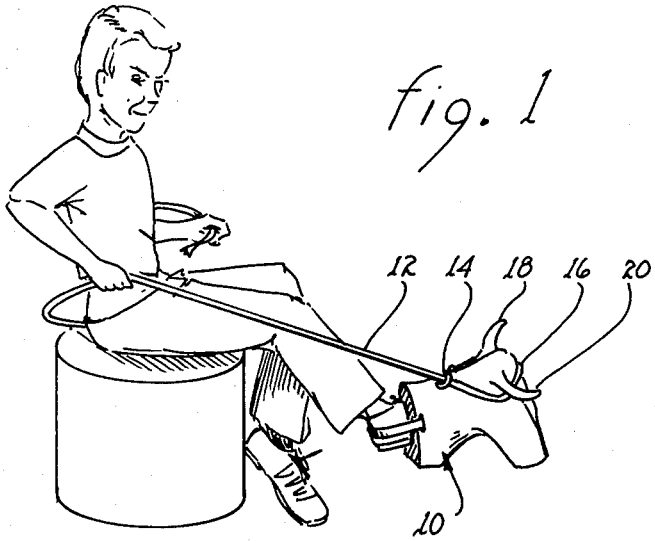
FIG. 1 illustrates the training device in use.

As illustrated in FIG. 1, simulated steer's head 10 may be used by a youngster when he is in a seated position. The simulated steer's head is mounted upon and attached to the youngster's foot whereby movement of his foot and/or leg results in a commensurate movement of the simulated steer's head. A short rope 12, which may be a pigging string, is formed with a rope honda 14 through which the rope is passed to form a loop 16.

To practice roping, the youngster throws rope 12 with loop 16 developed therein in an effort to drop the loop over horns 18 and 20 of the simulated steer's head. When a youngster is beginning to learn how to rope, he may simply keep his foot still to maintain the simulated steer's head as a stationary target. As his skill advances and to develop his eye and hand coordination, the youngster may swing his foot, twist it back and forth or pivot it about his ankle or a combination thereof, to move simulated steer's head 10 in all three axis, either individually or in combination. The resulting target is simulative of that of a live steer and it will afford the youngster the opportunity to develop substantial skills so that he is able to repetitively rope the simulated steer's head while he is simultaneously moving it.

The youngster can practice roping the simulated steer's head while seated indoors, seated outdoors or even while seated within a moving vehicle. Moreover, the simulated steer's head is relatively small to allow ease in transporting it. In one embodiment of the device, the spread of the horns is twelve inches. It may be manufactured as a hollow unit of reinforced fiberglass plastic or similar relatively light weight and strong material. By using mass production rotational molding techniques, the simulated steer's head can be reproduced relatively inexpensively.

Figure 2:
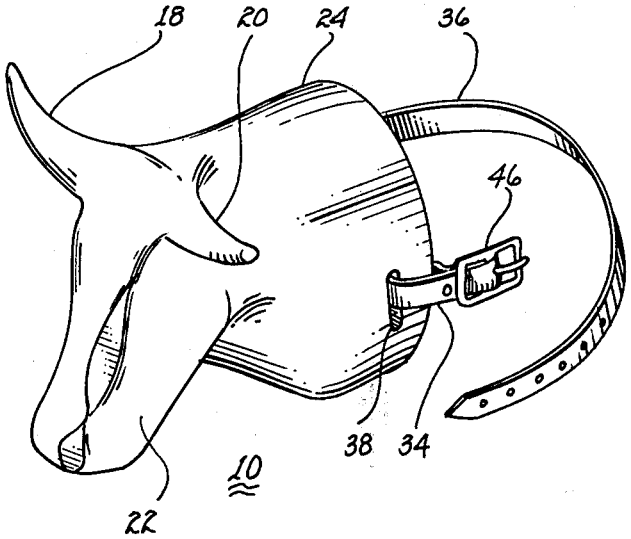
FIG. 2 is an isometric view of the training device.
Figure 4:
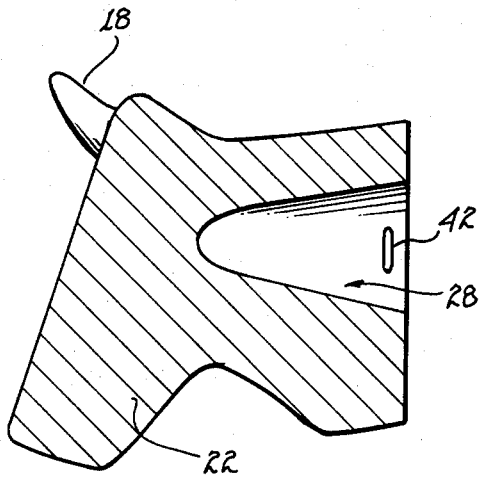
FIG. 4 is a cross-sectional view thereof.
Figure 3:
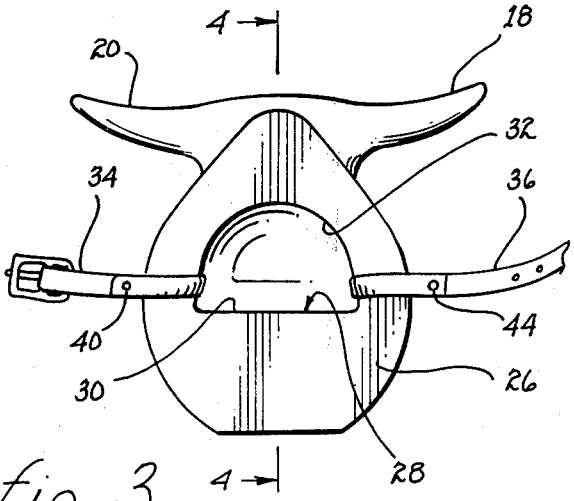
FIG. 3 is a rearview thereof.

Turning now to FIGS. 2, 3 and 4, the details of the simulated steer's head will be described. The simulated steer's head includes a head 22 from which horns 18 and 20 extend. The spread of the horns is at least 12 inches. A neck portion 24 extends rearwardly therefrom and is terminated by rear or planar surface 26. A cavity 28 extends internal to the simulated steer's head from planar surface 26 to receive the toes and major portion of the youngster's foot. The cavity includes a lower planar surface 30 and a rounded upper surface 32, which surfaces conformingly receive the youngster's foot, whether or not he is wearing shoes. Such conforming fit tends to maintain the simulated steer's head upon the youngster's foot without undue relative motion therebetween. As noted in FIG. 4, cavity 28 tapers inwardly in general conformance with the fore part of a youngster's foot.

As can be seen by comparing FIGS. 3 and 4, the combined length of the neck portion and the head from the terminal neck surface to the base of the horns is greater than one half of the horn span. Thus, such combined neck and head length is greater than the radius of a thrown loop which has a size sufficiently large to enable it to pass over the horns.

To maintain the simulated steer's head in place, straps 34 and 36 extend from opposed sides of planar surface 26 rearwardly about the heel of the youngster's foot. Strap 34 may be secured by passing one end thereof through aperture 38 and folding it back upon itself and securing the folded end in place by means, such as rivet 40. Similarly, strap 36 may be secured by passing one end through aperture 42 and folding it back upon itself and securing the folded end to the strap by means, such as rivet 44. A buckle 46 or similar means may be employed to secure the other ends of the straps to one another.

From the above description, it may be noted that the training apparatus described does indeed simulate a steer's head. Such simulation is relatively important in that a different shape would have a different effect upon the loop as it falls upon the head. The resulting different effect might have a tendency to provide a different "action" to the rope while the loop is drawn closed or as the loop is snugged up under the engaged horns. Were the "action" not simulative of real life, a false sense of confidence in the youngster's own ability might arise.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A foot mounted training device having a target for developing roping skills, said device being mountable upon and solely supported by one of the trainee's feet to locate the target at a sufficient distance to prevent interference of a thrown loop of the rope with the trainee's leg, said device comprising in combination:

(a) a simulated steer head;

(b) simulated horns extending in opposed lateral directions from said head and serving as the target about which the thrown loop of the rope is to fall and be drawn tight by the trainee;

(c) an elongated neck portion extending from said head and including a terminal end, said neck portion and said head being in combination of sufficient fore and aft length to define a distance from the base of said horns to said terminal end greater than one half of the span of said horns and thus also greater than the radius of the thrown loop which is necessary for the thrown loop to fall past said horns;

(d) a cavity extending into said neck portion from said terminal end for receiving the toes and ball of the trainee's foot; and (e) strap means extending rearwardly from said neck portion for strapping said head and said neck portion to the trainee's foot to maintain the trainee's toe and ball of the foot within said cavity during vigorous vertical and horizontal movement of the trainee's foot, said strap means in combination with said cavity providing the sole support for maintaining said roping target upon the trainee's foot to leave the trainee's hands free to cast the rope;

whereby, the target is sufficiently removed from the trainee's leg to permit unimpeded throwing and fall of a loop of the rope about said horns extending from said head.

2. The training device as set forth in claim 1 wherein said terminal end includes a planar surface circumscribing said cavity and said cavity includes a lower flat surface for supporting the sole of the trainee's foot and an upper curved surface for enveloping the top part of the trainee's foot.

3. The training device as set forth in claim 2 wherein said cavity tapers from said terminal end.

4. The training device as set forth in claim 3 wherein said strap means includes a first aperture extending through a part of said neck portion into said cavity, a first strap in penetrable engagement with said first aperture, a second aperture extending through another part of said neck portion into said cavity, a second strap in penetrable engagement with said second aperture and buckle means for securing said first and second straps to one another.

5. The training device as set forth in claim 4 wherein said training device is of reinforced fiberglass plastic material.

6. The training device as set forth in claim 5 wherein the spread of said simulated horns is at least 12 inches.

* * * * *